US006230532B1

(12) United States Patent
Kaji et al.

(10) Patent No.: US 6,230,532 B1
(45) Date of Patent: May 15, 2001

(54) METHOD AND APPARATUS FOR CONTROLLING SHEET SHAPE IN SHEET ROLLING

(75) Inventors: Takayuki Kaji; Takushi Kagawa; Hiroshi Shiomi, all of Chiba; Katsuhiro Takebayashi, Kurashiki, all of (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/533,550

(22) Filed: Mar. 23, 2000

(30) Foreign Application Priority Data

Mar. 31, 1999 (JP) ..... 11-090948

(51) Int. Cl.[7] ..... B21B 37/28
(52) U.S. Cl. ..... 72/9.1; 72/11.7
(58) Field of Search ..... 72/8.9, 9.1, 9.2, 72/11.6, 11.7, 11.8

(56) References Cited

U.S. PATENT DOCUMENTS 5,493,885 * 2/1996 Nomura et al. ..... 72/11.7
5,860,304 * 1/1999 Anbe et al. ..... 72/11.7
5,927,117 * 7/1999 Zhang ..... 72/11.7
5,960,657 * 10/1999 Anbe et al. ..... 72/11.7

* cited by examiner

*Primary Examiner*—Ed Tolan
(74) *Attorney, Agent, or Firm*—Oliff & Berridge, PLC

(57) ABSTRACT

During rolling with a rolling mill, which includes a sheet shape altering device capable of altering a mechanical sheet crown, while the sheet shape altering device is operated correspondingly with a target mechanical sheet crown set value during the dimensional alteration in rolling, the invention enables a stable sheet shape to be achieved, even when the mechanical sheet crown is altered to a large extent during rolling. Specifically, the target mechanical sheet crown set value, during the dimensional alteration in rolling, is previously set based on target mechanical sheet crown set values, before and after the dimensional alteration, prior to start of the dimensional alteration in rolling. The sheet shape altering device is then operated so that an actual mechanical sheet crown, during the dimensional alteration in rolling, is equal to the target mechanical sheet crown set value during the dimensional alteration in rolling.

13 Claims, 3 Drawing Sheets

METHOD AND APPARATUS FOR CONTROLLING SHEET SHAPE IN SHEET ROLLING

BACKGROUND OF THE INVENTION

1. Field of the Invention

The present invention relates to a sheet shape control method and apparatus, for use in case of changing rolling conditions, which alters sheet dimensions while a sheet is subjected to rolling (hereinafter referred to as a "dimensional alteration in rolling"). Such a case can occur when the same base material is rolled into sheets having various dimensions (including thickness (gauge), width, crown, etc.), i.e., the sheets have different thicknesses and/or widths, and when different types of base materials having different compositions are joined to each other and the joined base materials are rolled continuously.

2. Description of the Related Art

In order to continue processes and improve productivity, techniques of dimensional alteration in rolling for altering dimensions (including thickness, width, crown, etc.) of a sheet material under rolling have been developed in various fields. In the field of cold rolling mills, that technique has already been implemented in many plants. Recently, plants of hot rolling mills have also increasingly employed the dimensional alteration in rolling with the progress of various peripheral techniques.

The dimensional alteration in rolling is performed in the following four cases:

(1) Producing a plurality of sheet products that have a different thickness from a base material having the same composition, (2) Producing a plurality of sheet products that have a different width from a base material having the same composition, (3) Producing a plurality of sheet products that have a different width and thickness from a base material having the same composition, and (4) Joining base materials having different compositions from each other, and rolling the joined base materials continuously. In this case, dimensions and compositions of base materials that are joined to each other may be the same or different.

The dimensional alteration in rolling is practically performed by abruptly changing rolling conditions during rolling, altering a thickness, width, etc. of a rolled sheet, and altering a sheet shape (e.g., roll bending apparatus, roll crossing apparatus, and work roll shifting apparatus). These apparatus are provided in a rolling mill. Accordingly, depending on the control of the sheet shape altering apparatus, a problem arises that the shape of the rolled sheet deteriorates, or an area that includes a shape failure is overly extended in the direction of rolling.

Related art methods for avoiding deterioration of a sheet shape is disclosed in, e.g., Japanese Unexamined Patent Publication Nos. 62-57704 and 4-351213.

Japanese Unexamined Patent Publication No. 62-57704 discloses a method for controlling a shape of a rolled sheet, in, for example, a rolling mill which employs, as sheet shape altering apparatus, a roll bending force, a roll shifting force, and a shift roll. According to the disclosed method, in the case of connecting materials, which are different from each other in thickness, width or both thickness and width, and rolling the connected materials continuously, a mechanical sheet crown model formula is set in advance, which represents a relationship between transverse thickness distribution and rolling conditions resulting when a transverse rolling load acting between the rolled sheet and a work roll is held constant. Using the mechanical sheet crown model formula, or another calculation formula obtained by simplifying and/or modifying the former, the method calculates amounts by which the sheet shape altering apparatus are to be operated in a joined portion between the materials and thereabout. Then, the shape of the sheet under rolling is controlled at a predetermined timing based on the calculated amounts.

Also, the above-cited Japanese Unexamined Patent Publication No. 4-351213 discloses a method for controlling a shape of a rolled sheet by employing, as sheet shape altering apparatus, a roll bending force and a roll cross angle of work rolls, in the case of connecting different types of coils to each other, and rolling the connected coils continuously.

More specifically, as shown in FIG. 2, control of the roll cross angle, which has a slow operating speed, is started toward a target value of the roll cross angle for a succeeding sheet prior to the start of thickness (gauge) alteration. At the same time, adjustment of the roll bending force is also started so as to compensate for the control of the roll cross angle. Then, in synchronism with the thickness alteration, the roll bending force is altered correspondingly with the intended thickness alteration. The control is thus performed so that, at the time when the alteration of the roll cross angle is ended, the roll cross angle and the roll bending force are adjusted to set values for the succeeding sheet.

In any of the above-described methods, an amount of the shape control for a succeeding sheet is estimated before the thickness alteration point reaches a relevant rolling stand, and the amounts by which shape control devices are to be operated are determined based on the estimated amount of the shape control. Therefore, if the target mechanical sheet crown, at the leading end of a succeeding sheet that has been estimated in advance coincides with the actual mechanical sheet crown, a material having been rolled has a satisfactory shape.

In practice, however, a difference, between the target mechanical sheet crown estimated in advance for the leading end of a succeeding sheet, and the actual mechanical sheet crown for the same, may often become substantial, because the actual rolling load fluctuates due to estimation errors of the temperature of a rolled sheet, estimation errors of the resistance to deformation of the rolled sheet, variations in actual thickness, etc. In such an event, the shape control cannot be achieved with a satisfactory level, and inappropriate shape variations occur in a material that has been rolled. Large shape variations raise problems, such as causing the sheet to fracture, and making it difficult to thread the rolled sheet.

The above problems are attributable to the fact that the target mechanical sheet crown is not set during the dimensional alteration in rolling. In other words, an error of the mechanical sheet crown during the dimensional alteration in rolling cannot be evaluated because the target is not set, and the error cannot be corrected by operating the sheet shape altering apparatus.

In the dimensional alteration during rolling, generally, the dimensional alteration is performed in a plurality of rolling stands, with the same point of the rolled sheet set to a start point in order to increase yield. This gives rise to a complicated phenomenon, wherein dimensions of the rolled sheet on both the entry and delivery sides of each rolling stand are altered at the same time.

For the dimensional alteration accompanying such a complicated phenomenon, it has been heretofore considered to be difficult to estimate a mechanical sheet crown, during the dimensional alteration in rolling, with a practically satisfactory level of accuracy, by using a simplified model. On the other hand, computers have been unable to provide for the use of a complex model. For these reasons, it has been customary to only determine the amounts, by which the sheet shape altering apparatus are to be operated, before and after the dimensional alteration in rolling, as with the above-described related art, and setting a target mechanical sheet crown during the dimensional alteration in rolling has been regarded as infeasible.

Further, since hot finish rolling has been heretofore only been applied to rolling steel sheets with a thickness of 1.2 mm or more, no problems have occurred in practical operation, even with conventional methods, in spite of not correcting a shape failure during dimensional alteration from a preceding sheet to a succeeding sheet (i.e., during the dimensional alteration in rolling).

In continuous hot finish rolling which was first performed by Applicants, and in which hot finish rolling is applied to steel sheets with a thickness that is reduced down to 0.8 mm, however, another problem is encountered wherein that fracture of steel sheets occurs unless control, for preventing a shape failure, is continued, even during the dimensional alteration in rolling.

Moreover, Japanese Unexamined Patent Publication No. 59-64111, for example, discloses a method, as one of conventional techniques for controlling a target mechanical sheet crown to be held coincident with an actual mechanical sheet crown during rolling. The disclosed technique is intended to alter an amount of the shape control effected by the sheet shape control apparatus corresponding to a variation in rolling load that is a main cause of variations in mechanical sheet crown.

With the method disclosed in Japanese Unexamined Patent Publication No. 59-64111, however, the target mechanical sheet crown is controlled to be coincident with the actual mechanical sheet crown during rolling, so that the same target mechanical sheet crown is maintained in a single material. Therefore, alteration of the target mechanical sheet crown is not required. By contrast, in the case of rolling materials, that have different dimensions, continuously, as described above, a stable sheet shape is difficult to achieve unless the target mechanical sheet crown is positively altered between a preceding sheet and a succeeding sheet during continuous rolling. Japanese Unexamined Patent Publication No. 59-64111 discloses nothing with regards to a method for altering the target mechanical sheet crown, and hence is difficult to apply to the dimensional alteration in rolling.

SUMMARY OF THE INVENTION

The present invention is based on the conception of computing a target mechanical sheet crown during the dimensional alteration in rolling which has not been taken into consideration in the past, determining an error between the target mechanical sheet crown and an actual mechanical sheet crown from moment to moment, and operating sheet shape altering apparatus in accordance with the determined error. In other words, a target mechanical sheet crown during the dimensional alteration in rolling from a preceding sheet to a succeeding sheet is computed using a target mechanical sheet crown of a preceding sheet and a target mechanical sheet crown of a succeeding sheet. Specifically, a shape control method is realized by setting the target mechanical sheet crown during the dimensional alteration in rolling as an arbitrary function, that connects a mechanical sheet crown set value of the preceding sheet, and a mechanical sheet crown set value of the succeeding sheet. The arbitrary function may be given as an appropriate function representing a straight line, a curved line, etc.

An object of the present invention is to provide a shape control method in sheet rolling, which enables a stable sheet shape to be ensured even when sheet dimensions are altered to a large extent during rolling.

To achieve the above object, the present invention provides a shape control method used for rolling with dimensional alteration in rolling, wherein when a sheet material is continuously rolled by a rolling mill, which includes a sheet shape altering device capable of altering a mechanical sheet crown, the sheet shape altering device is operated in accordance with target mechanical sheet crown set values before and after the dimensional alteration. The method includes the steps of previously setting a target mechanical sheet crown set value during the dimensional alteration in rolling, based on the target mechanical sheet crown set values before and after the dimensional alteration, prior to start of the dimensional alteration in rolling; and operating the sheet shape altering device so that an actual mechanical sheet crown during the dimensional alteration in rolling is equal to the target mechanical sheet crown set value during the dimensional alteration in rolling.

Also, the present invention provides a shape control method, wherein the method is used for rolling with dimensional alteration in rolling, in which a rolled material includes a plurality of sheet materials joined to each other, and the sheet shape altering device is operated in accordance with target mechanical sheet crown set values of a preceding sheet and a succeeding sheet. The method includes the steps of previously setting a target mechanical sheet crown set value during the dimensional alteration in rolling, based on the target mechanical sheet crown set values of the preceding sheet and the succeeding sheet, prior to start of the dimensional alteration in rolling; and operating the sheet shape altering device so that an actual mechanical sheet crown, during the dimensional alteration in rolling, is equal to the target mechanical sheet crown set value during the dimensional alteration in rolling.

Further, the present invention provides a shape control method, wherein the method is used for rolling with dimensional alteration in rolling, in which a rolled material is a single sheet material, that has a different thickness and/or width in a direction of rolling, and the sheet shape altering device is operated in accordance with target mechanical sheet crown set values before and after the dimensional alteration. The method includes the steps of previously setting a target mechanical sheet crown set value during the dimensional alteration in rolling, based on the target mechanical sheet crown set values before and after the dimensional alteration, prior to the start of the dimensional alteration in rolling, and operating the sheet shape altering device so that an actual mechanical sheet crown, during the dimensional alteration in rolling, is equal to the target mechanical sheet crown set value during the dimensional alteration in rolling.

In addition, the present invention provides a shape control apparatus used in sheet rolling for operating a sheet shape altering device for the purpose of dimensional alteration in rolling in a process of continuously rolling a preceding sheet, and a succeeding sheet connected to the preceding sheet, or in a process of rolling a single coil. The apparatus includes a set-amount computing unit that sets an amount, by which the sheet shape altering device is to be operated during the dimensional alteration in rolling, based on target mechanical sheet crown set values before and after the dimensional alteration, prior to start of the dimensional alteration in rolling; and a sheet-shape-altering-device correction-amount computing unit that computes a target mechanical sheet crown during the dimensional alteration in rolling, based on the target mechanical sheet crown set values before and after the dimensional alteration, and correcting the amount, by which the sheet shape altering device is to be operated, depending on a difference, between the target mechanical sheet crown during the dimensional alteration in rolling, and an actual mechanical sheet crown during the dimensional alteration in rolling.

DESCRIPTION OF THE PREFERRED EMBODIMENT

Figure 1:
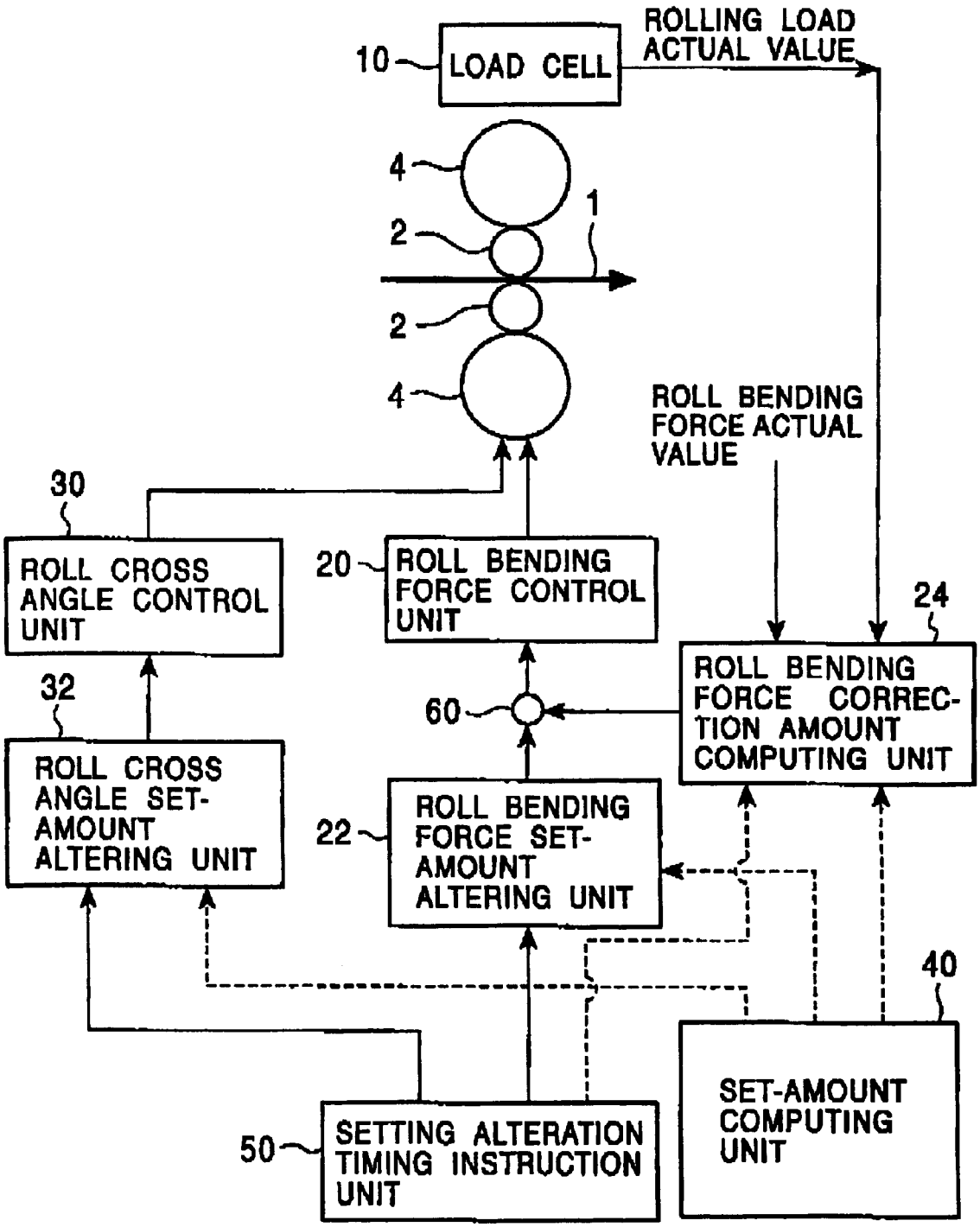
FIG. 1 is a block diagram showing an embodiment of the present invention.
Figure 2:
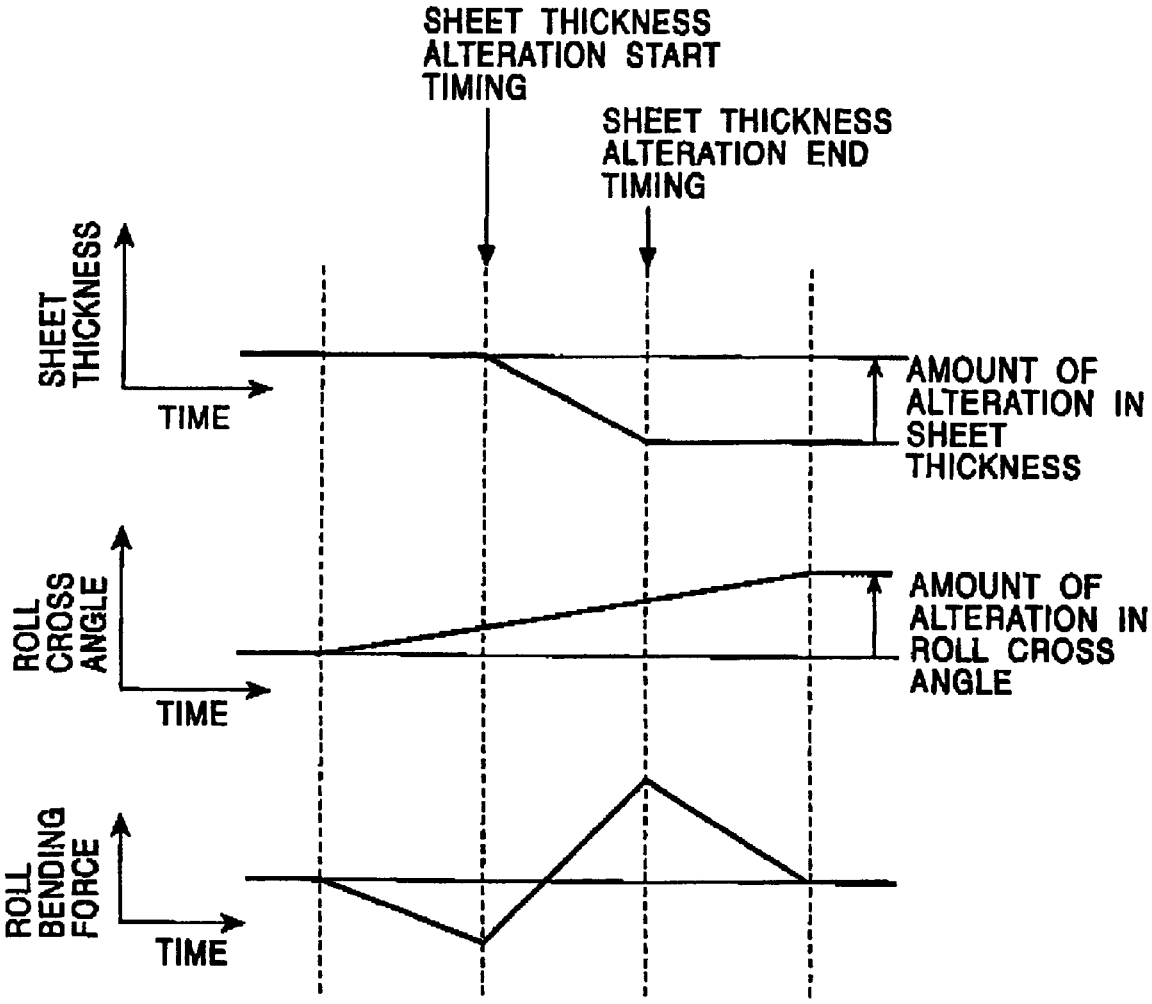
FIG. 2 is a time chart that shows a conventional control method.

The present invention will be described below in more detail, in accordance with an example of a rolling mill that includes, as sheet shape control apparatus, roll bending apparatus and roll crossing apparatus.

Considering a mechanical sheet crown from the viewpoint of factors such as a rolling load, a roll bending force, a roll cross angle, and a roll crown, the mechanical sheet crown can be expressed by the sum of those factors, as shown in the following formula (1);

$$Ch=\text{func}CP(P)+\text{func}CB(B)+\text{func}CC(C)+\text{func}CW(C_W) \quad (1)$$

where Ch: mechanical sheet crown, funcCP: rolling load component of mechanical sheet crown, funcCB: roll bending force component of mechanical sheet crown, funcCC: roll cross angle component of mechanical sheet crown, funcCW: roll crown component of mechanical sheet crown, P: rolling load, B: rolling bending force C: roll cross angle, and $C_W$: roll crown.

An actual mechanical sheet crown during the dimensional alteration in rolling is also expressed by the above formula.

Also, assuming that a target mechanical sheet crown during the dimensional alteration in rolling is $Ch_{FGC}$, a target rolling load is $P_{FGC}$, a target roll bending force set value is $B_{FGC}$, and a target roll cross angle is $C_{FGC}$, the target mechanical sheet crown is expressed by the following formula (2):

$$Ch_{FGC}=\text{func}CP(P_{FGC})+\text{func}CB(B_{FGC})+\text{func}CC(C_{FGC})+\text{func}CW(C_W) \quad (2)$$

Accordingly, a mechanical sheet crown error ΔCh occurring during the dimensional alteration in rolling is expressed by the following formula (3):

$$\Delta Ch=Ch-Ch_{FGC}=\text{func}CP(P-P_{FGC})+\text{func}CB(B-B_{FGC})+\text{func}CC(C-C_{FGC}) \quad (3)$$

Here, when the sheet shape altering apparatus are operated toward the respective set values for a succeeding sheet, while the roll bending force during the dimensional alteration in rolling is held correspondingly with the target roll bending force set value $B_{FGC}$, and the roll cross angle during the dimensional alteration in rolling is held correspondingly match with the target roll cross angle set value $C_{FGC}$, the mechanical sheet crown error ΔCh occurring during the dimensional alteration in rolling is the same as a mechanical sheet crown component corresponding to an estimation error of the rolling load, as shown by the following formula (4):

$$\Delta Ch=\text{func}CP(P-P_{FGC}) \quad (4)$$

Therefore, a shape variation occurring due to the mechanical sheet crown error during the dimensional alteration in rolling can be suppressed, by detecting the rolling load error during the dimensional alteration in rolling, and further adjusting the roll bending force, so that the rolling load error is canceled.

Control of the roll bending force for canceling the rolling load error can be performed as follows.

Usually, effects of the roll bending force and the rolling load upon the mechanical sheet crown are approximated using a linear function in many cases, as expressed by the following formula (5);

$$\Delta Ch=kP\times(P-P_{SET})+kB\times(B-B_{SET}) \quad (5)$$

where kP, kB: effect coefficient depending on rolled sheet, $P_{SET}$: rolling load reference value, and $B_{SET}$: roll bending force reference value. Accordingly, a roll bending force ΔB necessary to suppress the mechanical sheet crown error, which is determined by the above formula (4), and is attributable to the rolling load error, can be given by the following formula (6);

$$\Delta B=k\times(P-P_{FGC}) \quad (6)$$

where k: value computed from kP and kB in the above formula (5).

The target rolling load $P_{FGC}$ during the dimensional alteration in rolling can be calculated based on conditions, such as the hardness of a rolled sheet, the thickness thereof on the entry side, and the thickness thereof on the delivery side. Alternatively, the target rolling load $P_{FGC}$ may be calculated based on an arbitrary function that connects the rolling load set value of a preceding sheet and the rolling load set value of a succeeding sheet. The arbitrary function may be given as an appropriate function representing a straight line, a curved line, etc. Where a time of the dimensional alteration in rolling is as short as, for example, one second, as within several times of a response time of the roll bending force, the target rolling load $P_{FGC}$ may be calculated by connecting the rolling load set value of the preceding sheet and the rolling load set value of the succeeding sheet.

The shape control method of the present invention is applicable to any of the following cases:

(1) Connecting the tail end of a preceding sheet, which is conveyed ahead, to the leading end of a succeeding sheet, which is conveyed subsequent to the preceding sheet, and rolling a connected material continuously, and (2) Rolling a single material while a sheet shape is altered in rolling.

<Embodiment>

An embodiment of the present invention will be described with reference to FIGS. 1 and 3, in accordance with an example of a rolling mill that includes a roll bending force control unit and a roll cross angle control unit for the sheet shape altering apparatus.

FIG. 1 is a block diagram that shows the control method of the present invention. FIG. 1 shows a rolled sheet 1, a pair of work rolls 2 of a rolling mill, and a pair of back-up rolls 4 of the rolling mill.

When the dimensional alteration in rolling is carried out in the rolling mill, a target mechanical sheet crown set value is set in advance, based on target mechanical sheet crown set values of a sheet, which is to be rolled but not yet rolled, before and after the dimensional alteration.

To that end, a set-amount computing unit 40 computes a target mechanical sheet crown for a succeeding sheet. Based on the computed target mechanical sheet crown, the set-amount computing unit 40 then transmits a roll bending force set value and a roll cross angle set value of the succeeding sheet, respectively, to a roll bending force set-amount altering unit 22 and a roll cross angle set-amount altering unit 32. Computing the target mechanical sheet crown in the set-amount computing unit 40, depending on the rolled sheet, is performed based on, for example, sheet crown target values on the entry and delivery sides of a rolling stand, control capabilities of sheet shape altering apparatus, etc.

On the other hand, a setting alteration timing instruction unit 50 determines a position of a point to start alteration of the mechanical sheet crown by using known methods and apparatus. Then, at a predetermined timing of starting the dimensional alteration in rolling while the sheet is subjected to rolling, the setting alteration timing instruction unit 50 outputs a timing of altering each, of the roll bending force set value and the roll cross angle, set to each, of the roll bending force set-amount altering unit 22 and the roll cross angle set-amount altering unit 32.

Simultaneously, the sheet shape altering apparatus are operated so that an actual mechanical sheet crown, during the dimensional alteration in rolling, is equal to the previously set target mechanical sheet crown during the dimensional alteration in rolling. To that end, a roll bending force correction-amount computing unit 24 computes a target rolling load during the dimensional alteration in rolling from moment to moment, by using a dimensional-alteration-in-rolling start signal transmitted from the setting alteration timing instruction unit 50 and rolling information transmitted from the set-amount computing unit 40, and then computes a roll bending force correction amount from the above formula (6), depending on a difference between the target rolling load and a rolling load actual value, which is computed using an actual load value detected by a load cell 10 and a roll bending force actual value detected by a roll bending force sensor (not shown).

The roll bending force set amount determined by the roll bending force set-amount altering unit 22, and the roll bending force correction amount determined by the roll bending force correction-amount computing unit 24, are added in an adder 60, and a resultant roll bending force is set to a roll bending force control unit 20, thus enabling the roll bending force to be altered from moment to moment during the dimensional alteration in rolling.

Figure 3A:
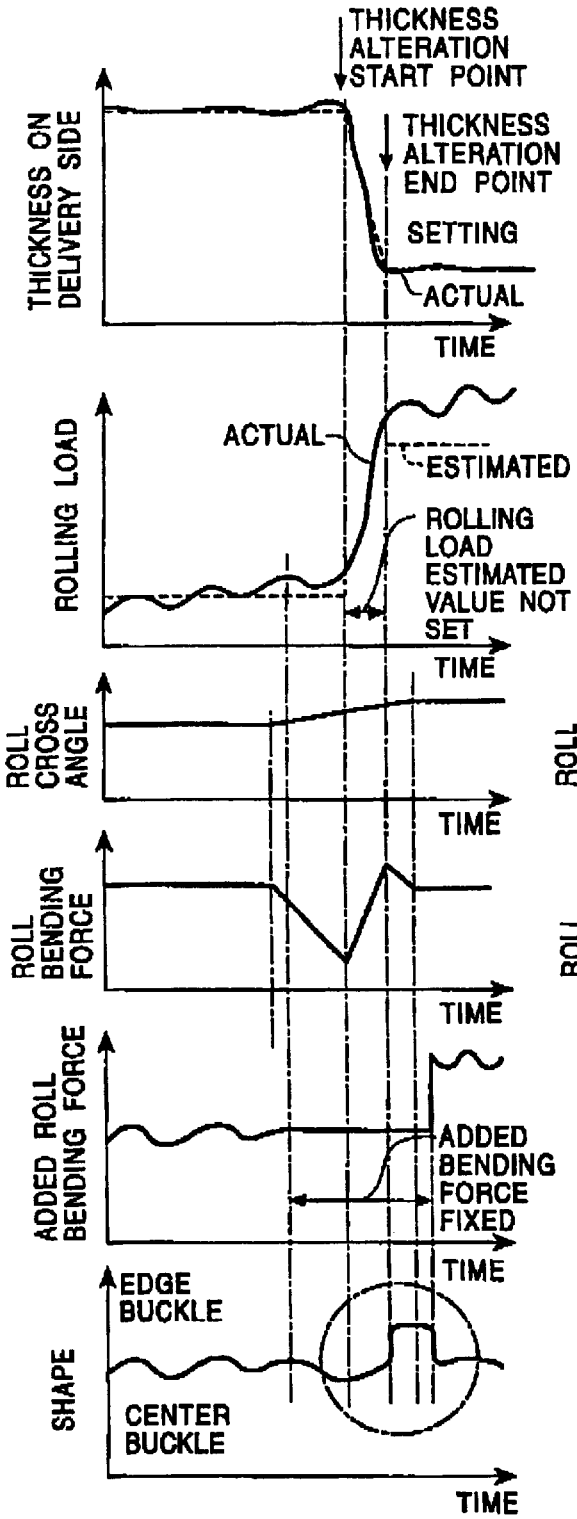
FIGS. 3A and 3B are sets of graphs that show an advantage of the present invention.
Figure 3B:
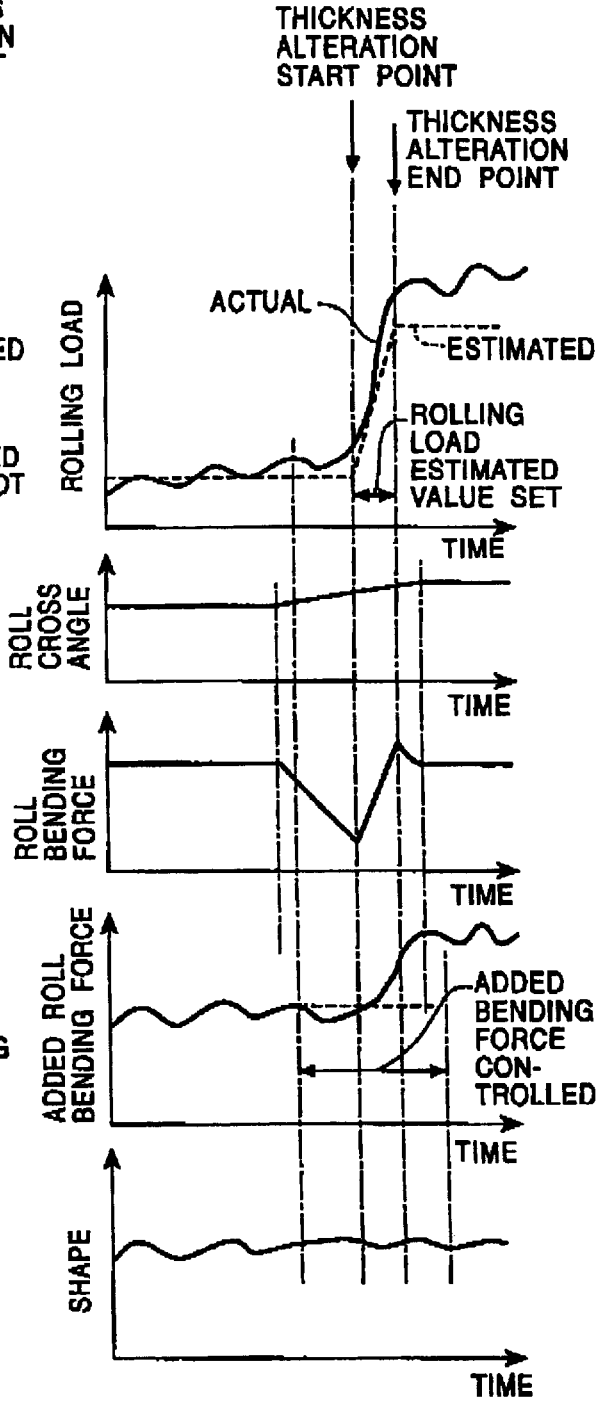

FIGS. 3A and 3B show the sheet shape control method according to the present invention in comparison with a conventional method. Specifically, FIGS. 3A and 3B show, respectively, time-serial changes in rolling load, roll cross angle, roll bending force, added roll bending force, and sheet shape, resulting when rolling a material, the thickness of which is altered in rolling, in accordance with the conventional method, as well as the method of the present invention. In the conventional method, adjustment of the roll cross angle and the roll bending force is started, before the start of the thickness (gauge) alteration in rolling toward the roll cross angle set value and the roll bending force set value of a succeeding sheet, in accordance with predetermined patterns. However, a mechanical sheet crown error, that occurs due to a rolling load error during the thickness alteration in rolling, cannot be dealt with, because the target mechanical sheet crown, as a reference for error determination, is not set. Thus, the added roll bending force before the start of the thickness alteration in rolling is held fixed, and after the end of the thickness alteration in rolling, the added roll bending force is corrected again in accordance with the mechanical sheet crown error. As a result, during a period in which the added roll bending force is held fixed, the roll bending force control, depending on the rolling load error, cannot be performed, and a shape failure, such as an edge buckle, is caused due to the rolling load error (i.e., the mechanical sheet crown error) as shown, for example, in FIG. 3A.

By contrast, in the method of the present invention, since the added roll bending force is variably controlled and applied from moment to moment, depending on an estimated error of the rolling load, stable threading of the rolled sheet can be achieved without causing substantial shape fluctuations. Also, fracture of the sheet can be surely prevented.

The above embodiment has been described, by way of example, in conjunction with a rolling mill that employs, as the shape control apparatus, a roll bending force and a roll cross angle. The present invention is however also applicable to a rolling mill that employs only a roll bending force as the sheet shape altering apparatus. A roll shifting device, for example, can be further employed as the shape control apparatus.

According to the present invention, an undesired change in sheet shape resulting from the dimensional alteration in rolling can be avoided by modifying setting of the shape control apparatus. In addition, shape variations resulting from estimation errors during the dimensional alteration in rolling can also be avoided by operating the shape control apparatus so that the estimation errors are canceled.

What is claimed is:

1. A shape control method used for rolling, wherein dimensional alteration is performed during the rolling, and wherein, when a sheet material is continuously rolled by a rolling mill, which includes a sheet shape altering apparatus that alters a mechanical sheet crown, said sheet shape altering apparatus controlled in accordance with target mechanical sheet crown set values before and after the dimensional alteration, said method comprising the steps of:

previously setting a target mechanical sheet crown set value, during the dimensional alteration that is performed during rolling, based on the target mechanical sheet crown set values before and after the dimensional alteration prior to start of the dimensional alteration in rolling; and continuously controlling said sheet shape altering apparatus so that an actual mechanical sheet crown during the dimensional alteration in rolling is equal to the target mechanical sheet crown set value during the dimensional alteration in rolling.

2. The shape control method according to claim 1, wherein a rolled material includes a plurality of sheet materials joined to each other, and said sheet shape altering apparatus is controlled in accordance with target mechanical sheet crown set values of a preceding sheet and a succeeding sheet, and wherein:

the previously setting step includes previously setting a target mechanical sheet crown set value, during the dimensional alteration that is performed during rolling, based on the target mechanical sheet crown set values of the preceding sheet and the succeeding sheet prior to start of the dimensional alteration in rolling; and the controlling step includes continuously controlling said sheet shape altering apparatus so that an actual mechanical sheet crown during the dimensional alteration in rolling is equal to the target mechanical sheet crown set value during the dimensional alteration in rolling.

3. The shape control method according to claim 1, wherein a rolled material is a single sheet material that is different in thickness and/or width in a direction of rolling, and said sheet shape altering apparatus is controlled in accordance with target mechanical sheet crown set values before and after the dimensional alteration, and wherein:

the previously setting step includes previously setting a target mechanical sheet crown set value, during the dimensional alteration that is performed during rolling, based on the target mechanical sheet crown set values before and after the dimensional alteration prior to start of the dimensional alteration in rolling; and the controlling step includes continuously controlling said sheet shape altering apparatus so that an actual mechanical sheet crown during the dimensional alteration in rolling is equal to the target mechanical sheet crown set value during the dimensional alteration in rolling.

4. The shape control method according to claim 1, wherein the target mechanical sheet crown set value $Ch_{FGC}$, during the dimensional alteration that is performed during rolling, is determined based on the following formula:

$$Ch_{FGC}=\text{func}CP(P_{FGC})+\text{func}CB(B_{FGC})+\text{func}CC(C_{FGC})+\text{func}CW(C_W)$$

where funcCP($P_{FGC}$): functional formula of a rolling load for the mechanical sheet crown with a target rolling load ($P_{FGC}$) being as a variable, funcCB($B_{FGC}$): functional formula of a roll bending force for the mechanical sheet crown with a target roll cross angle ($C_{FGC}$) being as a variable, and funcCC($C_{FGC}$): functional formula of a roll cross angle for the mechanical sheet crown with a target roll cross angle ($C_{FGC}$) being as a variable, and funcCW($C_W$): functional formula of a roll crown for the mechanical sheet crown with a roll crown ($C_W$) being as a variable.

5. The shape control method according to claim 1, further including the steps of detecting, with said sheet shape altering apparatus that maintains the actual mechanical sheet crown during the dimensional alteration in rolling equal to the target mechanical sheet crown set value during the dimensional alteration in rolling, an error between a target rolling load and an actual rolling load during the dimensional alteration in rolling, and applying a roll bending force so as to minimize the error.

6. The shape control method according to claim 5, further including the step of setting, the target rolling load during the dimensional alteration in rolling, as a function connecting a rolling load set value before the dimensional alteration in rolling and a rolling load set value after the dimensional alteration in rolling.

7. The shape control method according to claim 2, wherein the target mechanical sheet crown set value $Ch_{FGC}$, during the dimensional alteration that is performed during rolling, is determined based on the following formula;

$$Ch_{FGC}=\text{func}CP(P_{PGC})+\text{func}CB(B_{FGC})+\text{func}CC(C_{FGC})+\text{func}CW(C_W)$$

where funcCP ($P_{FGC}$): functional formula of a rolling load for the mechanical sheet crown with a target rolling load ($P_{FGC}$) being as a variable, funcCB ($B_{FGC}$): functional formula of a roll bending force for the mechanical sheet crown with a target roll bending force ($B_{FGC}$) being as a variable, funcCC ($C_{FGC}$): functional formula of a roll cross angle for the mechanical sheet crown with a target roll cross angle ($C_{FGC}$) being as a variable, and funcCW ($C_W$): functional formula of a roll crown for the mechanical sheet crown with a roll crown ($C_W$) being as a variable.

8. The shape control method according to claim 2, further including the steps of detecting, with said sheet shape altering apparatus that maintains the actual mechanical sheet crown during the dimensional alteration in rolling equal to the target mechanical sheet crown set value during the dimensional alteration in rolling, an error between a target rolling load and an actual rolling load during the dimensional alteration in rolling, and applying a roll bending force so as to minimize the error.

9. The shape control method according to claim 8, further including the step of setting, the target rolling load during the dimensional alteration in rolling, as a function connecting a rolling load set value before the dimensional alteration in rolling and a rolling load set value after the dimensional alteration in rolling.

10. The shape control method according to claim 3, wherein the target mechanical sheet crown set value ChFGC, during the dimensional alteration that is performed during rolling, is determined based on the following formula;

$$Ch_{FGC}=\text{func}CP(P_{FGC})+\text{func}CB(B_{FGC})+\text{func}CC(C_{FGC})+\text{func}CW(C_W)$$

where funcCP($P_{FGC}$): functional formula of a rolling load for the mechanical sheet crown with a target rolling load ($P_{FGC}$) being as a variable, funcCB($B_{FGC}$): functional formula of a roll bending force for the mechanical sheet crown with a target roll bending force ($B_{FGC}$) being as a variable, funcCC($C_{FGC}$): functional formula of a roll cross angle for the mechanical sheet crown with a target roll cross angle ($C_{FGC}$) being as a variable, and funcCW($C_W$): functional formula of a roll crown for the mechanical sheet crown with a roll crown ($C_W$) being as a variable.

11. The shape control method according to claim 3, further including the steps of detecting, with said sheet shape altering apparatus that maintains the actual mechanical sheet crown during the dimensional alteration in rolling equal to the target mechanical sheet crown set value during the dimensional alteration in rolling, an error between a target rolling load and an actual rolling load during the dimensional alteration in rolling, and applying a roll bending force so as to minimize the error.

12. The shape control method according to claim 11, further including the step of setting, the target rolling load during the dimensional alteration in rolling, as a function connecting a rolling load set value before the dimensional alteration in rolling and a rolling load set value after the dimensional alteration in rolling.

13. A shape control apparatus for operating a sheet shape altering apparatus that alters dimensions of a sheet during sheet rolling, in at least one of a process of continuously rolling a preceding sheet and succeeding sheet connected to the preceding sheet, and a process of rolling a single coil, said shape control apparatus comprising:

a set-amount computing unit that sets an amount, by which said sheet shape altering apparatus is to be operated during the dimensional alteration that is performed in rolling, based on target mechanical sheet crown set values before and after the dimensional alteration prior to start of the dimensional alteration in rolling; and a sheet shape altering apparatus correction amount computing unit that determines a target mechanical sheet crown during the dimensional alteration that is performed in rolling, based on the target mechanical sheet crown set values before and after the dimensional alteration, and continuously corrects the amount, by which said sheet shape altering apparatus is to be operated, depending on a difference between the target mechanical sheet crown during the dimensional alteration in rolling and an actual mechanical sheet crown during the dimensional alteration in rolling.

* * * * *